US009171487B2

(12) United States Patent
Adams et al.

(10) Patent No.: US 9,171,487 B2
(45) Date of Patent: Oct. 27, 2015

(54) MECHANICAL SIGN WAVING DEVICE

(71) Applicant: Velocity Signs, LLC, Sacramento, CA (US)

(72) Inventors: Scott Adams, Granite Bay, CA (US); Josh Faherty, Sacramento, CA (US)

(73) Assignee: Velocity Signs, LLC, Sacramento, CA (US)

( * ) Notice: Subject to any disclaimer, the term of this patent is extended or adjusted under 35 U.S.C. 154(b) by 0 days.

(21) Appl. No.: 14/515,398

(22) Filed: Oct. 15, 2014

(65) Prior Publication Data

US 2015/0027011 A1 Jan. 29, 2015

Related U.S. Application Data

(63) Continuation of application No. 13/648,084, filed on Oct. 9, 2012, now Pat. No. 8,887,424.

(60) Provisional application No. 61/588,637, filed on Jan. 19, 2012.

(51) Int. Cl.

| | |
|---|---|
| ***G09F 7/22*** | (2006.01) |
| ***G09F 19/02*** | (2006.01) |
| *G09F 7/18* | (2006.01) |

(52) U.S. Cl.

CPC *G09F 7/22* (2013.01); *G09F 19/02* (2013.01); *G09F 2007/1865* (2013.01)

(58) Field of Classification Search

CPC .... G09F 7/22; G09F 19/02; G09F 2007/1865
USPC ..... 40/614, 476; 116/63 P
See application file for complete search history.

(56) References Cited

U.S. PATENT DOCUMENTS

| | | | | | |
|---|---|---|---|---|---|
| 579,343 | A | * | 3/1897 | Gates | 40/614 |
| 902,496 | A | * | 10/1908 | Lafond | 40/614 |
| 1,556,133 | A | * | 10/1925 | Stanley | 40/614 |
| 2,245,940 | A | * | 6/1941 | Seares | 40/614 |
| 2,528,962 | A | * | 11/1950 | Lieutard | 116/63 P |
| 2,610,424 | A | * | 9/1952 | Millard | 40/614 |
| 2,688,813 | A | * | 9/1954 | Hart | 40/581 |
| 2,746,188 | A | * | 5/1956 | Sweetnam | 40/614 |
| 2,941,322 | A | * | 6/1960 | Harmon | 40/473 |
| 3,213,557 | A | * | 10/1965 | Clement | 40/614 |
| 3,375,600 | A | * | 4/1968 | Poulos | 40/614 |
| 3,417,498 | A | * | 12/1968 | Anthony | 40/470 |
| 3,562,941 | A | * | 2/1971 | Boden | 40/437 |
| 3,807,072 | A | * | 4/1974 | Luxon, Jr. | 40/433 |
| 3,886,519 | A | * | 5/1975 | Hovland | 340/908.1 |
| 4,777,751 | A | * | 10/1988 | Pasquale | 40/612 |
| 5,214,364 | A | * | 5/1993 | Perdue et al. | 318/600 |
| 5,294,138 | A | * | 3/1994 | Yang | 280/47.34 |
| 5,422,638 | A | * | 6/1995 | Singer et al. | 340/908.1 |
| 6,052,067 | A | * | 4/2000 | Nuxoll | 340/908 |
| 6,169,477 | B1 | * | 1/2001 | Fiato | 340/326 |
| 6,448,905 | B1 | * | 9/2002 | Jones | 340/907 |
| 6,502,338 | B1 | * | 1/2003 | Marshall | 40/430 |
| 2008/0078110 | A1 | | 4/2008 | Christian | |
| 2012/0047781 | A1 | | 3/2012 | Wondra et al. | |

* cited by examiner

*Primary Examiner* — Gary Hoge

(57) ABSTRACT

A sign waving apparatus that includes a base, a housing enclosing a motor, a frame support connecting the base and the housing, and a sign mount mechanically connected to a motor. The sign or signs attach to the surfaces of the sign mount. The sign mount moves relative to the housing in a variety of different motions.

20 Claims, 9 Drawing Sheets

MECHANICAL SIGN WAVING DEVICE

CROSS-REFERENCE TO RELATED APPLICATIONS

This application is a continuation of U.S. patent application Ser. No. 13/648,084 filed Oct. 9, 2012, which claims the benefit of priority from U.S. Provisional Application No. 61/588,637 entitled "MECHANICAL SIGN WAVING DEVICE", filed Jan. 19, 2012, the contents of both applications are incorporated herein by reference in their entirety.

FIELD OF THE INVENTION

The present invention relates generally to a mechanical sign waving device which replaces a human sign spinners that hold signs or move them around for advertising purposes.

BACKGROUND

There are many ways to promote one's products, businesses or operations. One frequently used method is by using signs. Signs can be used in a variety of ways, and in recent years, many businesses use human sign spinners who hold, spin or throw the signs to attract attention. Businesses generally place the sign spinners outdoors and in locations where substantial pedestrian or automobile traffic exist. Although effective, using sign spinners to perform such tasks present a number of limitations such as health risks, limited advertising time and higher costs.

Sign spinners generally work outdoors and are exposed to excessive heat or cold. In addition, in order to make advertising most effective, sign spinners position themselves at or near major traffic centers, further exposing them to hazardous exhaust gases from vehicles and/or getting hit by a vehicle.

Further, use of sign spinners is generally limited to daytime hours due to potential security risks. Additionally, in instances where sign spinners are used after dark, additional costs are incurred to provide lighting equipment. Finally, the sign spinners' wages can also add up resulting in unexpected cost issues for the advertiser.

Therefore, what is needed is a sign waving machine that can be operated without any temporal or geographical limitations.

SUMMARY

One embodiment includes a sign waving apparatus, comprising a base; a housing enclosing a motor, wherein a drive shaft of the motor is partially exposed outside of the housing; a frame support; and a sign mount coupled to the housing and the motor, wherein the sign mount moves relative to the housing.

In some embodiments, the motor can be adjusted to operate at different Revolutions Per Minute and in both rotational directions. Optionally, the frame support is further composed of a support pole and a lower frame, wherein the first end of the support pole is connected to the lower frame which provides attachment points for the base and the second end of the support pole is connected to the housing. In some embodiments, the sign mount is coupled to the housing by a set of swing shafts, wherein each swing shaft of the set of swing shafts has a first end and a second end and is configured to rotate freely around the first end and second end. Optionally, the sign mount is further coupled to the motor by a drive shaft, wherein the drive shaft has a fixed end and a free end and is configured to rotate freely around the free end and rotate relative to the housing at the fixed end.

In other embodiments, the sign mount can be further configured to have a first surface and a second surface to allow signs to be visible from both sides. Sometimes, the base encloses a battery, a rotation reversal switch, an on/off switch, a battery charger, a fuse holder or circuit breaker, a set of lights, solar energy controller and panel, global tracking device, or a locking latch. Optionally, the sign mount is coupled to the housing by a plurality of swing arms, wherein one of the swing arms is connected to the motor by a circular disc and a connector shaft.

In another embodiment includes a sign waving apparatus, comprising a base; a housing enclosing a motor, wherein a drive shaft of the motor is partially exposed outside of the housing; a frame support; a sign mount coupled to the housing and the motor, wherein the sign mount moves relative to the housing and the sign mount comprises a first surface and a second surface; and wherein a sign attaches to a portion of the first or second surface of the sign mount.

Optionally, the motor can be adjusted to operate at different Revolutions Per Minute and in both rotational directions. Sometimes, the frame support is further composed of a support pole and a lower frame, wherein the first end of the support pole is connected to the lower frame which provides attachment points for the base and the second end of the support pole is connected to the housing. The sign mount is optionally coupled to the housing by a set of swing shafts, wherein each swing shaft of the set of swing shafts has a first end and a second end and is configured to rotate freely around the first end and second end, and the sign mount is further coupled to the motor by a drive shaft, wherein the drive shaft has a fixed end and a free end and is configured to rotate freely around the free end and rotate relative to the housing at the fixed end. The sign mount can be further configured to have a first surface and a second surface to allow signs to be visible from both sides.

In some embodiments, the base encloses a battery, a rotation reversal switch, an on/off switch, a battery charger, a fuse holder, a set of lights, or a locking latch. Optionally, the sign mount is coupled to the housing by a plurality of swing arms, wherein one of the swing arms is connected to the motor by a circular disc and a connector shaft. Sometimes, the sign mount is coupled to the housing by a shaft, wherein the shaft is connected to the motor.

Some other embodiments provides an apparatus for automatically waving signs. In some embodiments, the apparatus includes, a base, a housing enclosing a motor, a frame support, and a sign mount coupled to the housing and the motor, where the sign mount moves relative to the housing.

In one embodiment, the motor can be adjusted to operate at different Revolutions Per Minute and in both rotational directions. Optionally, the frame support is composed of a support pole and a lower frame. In one embodiment, the first end of the support pole is connected to the lower frame so that it provides attachment points for the base and the second end of the support pole is connected to the housing. The sign mount is optionally coupled to the housing by a set of swing shafts and the sign mount is further coupled to the motor by a drive shaft. The sign mount can be further configured to have a first surface and a second surface to allow signs to be visible from both sides. The base may enclose a battery, a rotation reversal switch, an on/off switch, a battery charger, a fuse holder, a circuit breaker, a set of lights, solar energy controller and panel, global tracking device, or a locking latch. The frame support can be additionally connected to a set of wheels, an extendable platform, and an attachment point for the base, which allows a dummy to be placed on the platform. In some embodiments, the sign mount is coupled to the housing by a circular disc connected to the motor, a pivot point connecting the sign mount to the housing and a spring connecting the sign mount to the vertical frame support. In another embodiment, the sign mount is coupled to the housing by a circular disc connected to the motor tracking an elongated opening on the sign mount and a pivot point. In still another embodiment, the sign mount is coupled to the housing by a plurality of swing arms, wherein one of the swing arms is connected to the motor by a circular disc and a connector shaft.

In yet another embodiment, the apparatus includes a base, a housing enclosing a motor, a frame support, a sign mount coupled to the housing and the motor, where the sign mount moves relative to the housing, and where the sign attaches to a portion of the first or second surface of the sign mount.

Another embodiment includes a sign waving apparatus, comprising a base, a housing enclosing a motor, a frame support coupled to the base and the housing and a sign mount coupled to the housing and the motor, wherein the sign mount moves relative to the housing, wherein the sign mount is coupled to the housing by a set of swing shafts, wherein each swing shaft of the set of swing shafts has a first end and a second end.

Optionally, each swing shaft is configured to rotate freely around the first end and second end. The sign mount is further optionally coupled to the motor by a drive shaft, wherein the drive shaft has a fixed end and a free end and is configured to rotate freely around the free end and rotate relative to the housing at the fixed end. The motor can be adjusted to operate at different Revolutions Per Minute and in both rotational directions. The frame support is further optionally composed of a support pole and a lower frame, wherein the first end of the support pole is connected to the lower frame which provides attachment points for the base and the second end of the support pole is connected to the housing. In some embodiments, a draft shaft of the motor is partially exposed outside of the housing. Sometimes, the first swing shaft is a first length and the second swing shaft is a second length that is different from the first length.

BRIEF DESCRIPTION OF THE DRAWINGS

The features and advantages of the present embodiments will be apparent from the following description, presented in conjunction with the following drawings, wherein.

Skilled artisans will appreciate that elements in the figures are illustrated for simplicity and clarity and have not necessarily been drawn to scale. For example, the dimensions, sizing, and/or relative placement of some of the elements in the figure may be exaggerated relative to other elements to help to improve understanding of various embodiments of the invention. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION OF THE DRAWINGS

In the following paragraphs, the present embodiments will be described in detail by way of example with reference to the attached drawings. Throughout this description, the preferred embodiment and examples shown should be considered as exemplars, rather than as limitations on the present embodiments.

Figure 1:
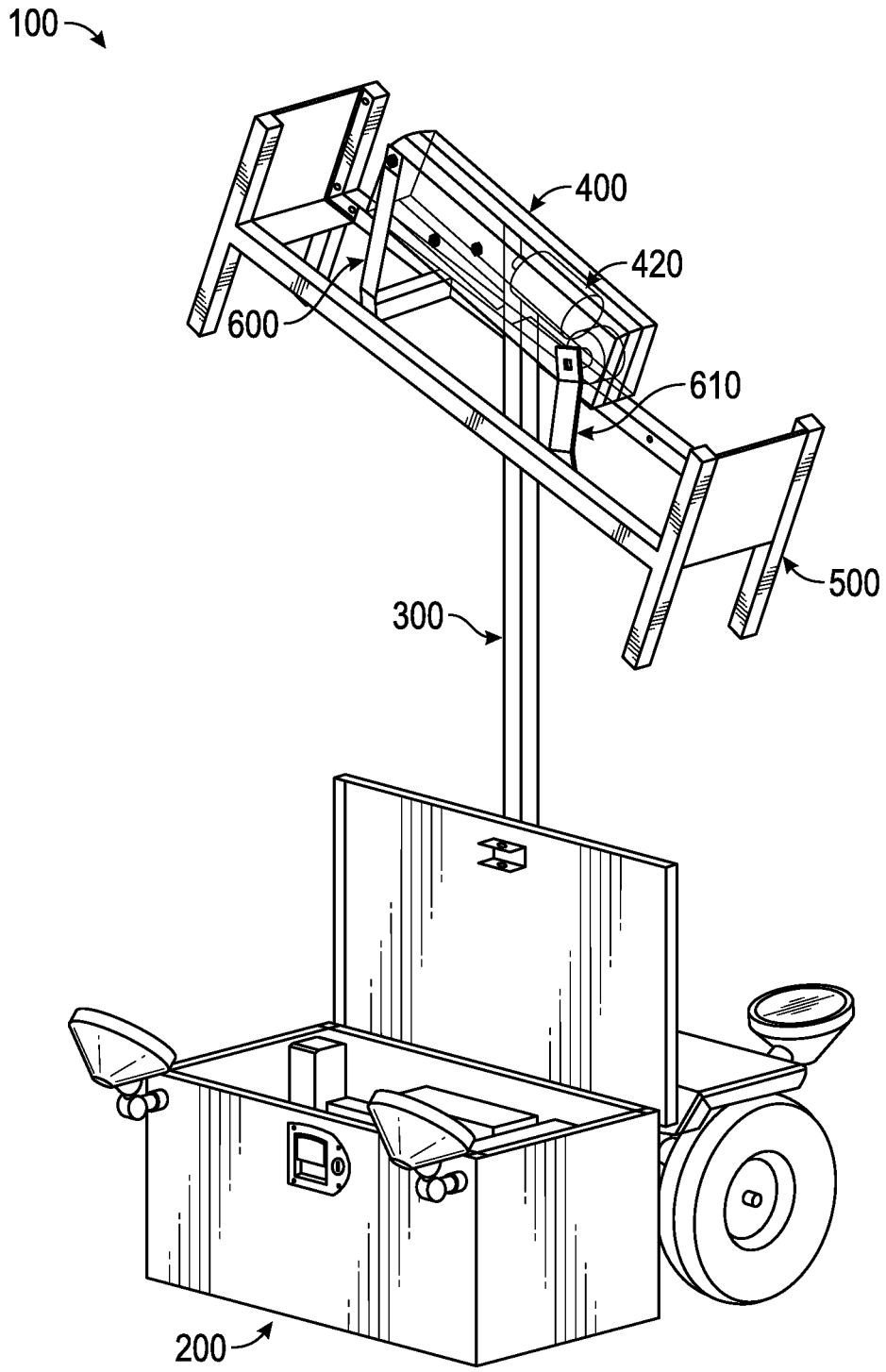
FIG. 1 is an illustration of an apparatus according to one embodiment.

FIG. 1 illustrates an embodiment of the sign waving apparatus 100 having a base 200, a frame support 300, a housing 400 enclosing a motor 420, a sign mount 500, a swing shaft 600, and a drive shaft 610. FIG. 1 depicts the various elements of one embodiment for the sign waving apparatus.

As shown in FIG. 1, the embodiment consists of a base 200 attached to one end of the frame support 300, and a housing 400 attached to the other end of the frame support 300. The housing 400 is coupled to the sign mount 500 by one or multiple swing shafts 600 and a drive shaft 610.

The base 200 encloses components that are used to operate the device, such as a battery, components to charge the battery, or an on/off switch. In addition, the base 200 provides additional support and acts as a counterweight, reducing the possibility that the sign waving device will tip over. The frame support 300 provides attachment points for the base 200 and the housing 400. Additionally, the connection between the frame support 300 and the housing 400 allows the user to adjust the housing's 400 height of attachment. The housing 400 encloses a motor 420 that provides the torque which results in the sign mount's 500 movement. The motor 420 is partially exposed such that a drive shaft 610 can be connected to the motor 420. The motor 420 is connected to the base 200 via a plurality of wires that are enclosed within the frame support 300 that provides the motor 420 with power and electric signals necessary to operate the motor 420. The housing 400 is mechanically coupled to the sign mount 500 using one or more swing shafts 600 and a drive shaft 610.

The sign mount 500 resembles a box-shaped truss structure and has both an outside and an inside surface. The inside surfaces have a series of holes that are used to connect to the swing 600 and drive shafts 610. The outside surfaces are configured such that signs can be attached to these surfaces. The first end of the swing shaft 600 is connected to the housing 400, preferably on the same side of the housing 400 where the motor 420 is partially exposed. The first end provides a pivot point for the swing shaft 600. The second end of the swing shaft 600 is connected to the housing-facing side of the sign mount 500. The drive shaft 610 is connected to the motor 420 on one end and the sign mount 500 on the other end. The drive shaft 610 is connected to the motor 420 directly or indirectly via multiple gears or a gearbox. The torque provided by the motor 420 rotates the drive shaft 610, which in turn provides the swinging or rocking motion of the sign mount 500. A number of different combinations of swing shafts 600 and other connectors can be used to connect the sign mount 500 to the housing 400 and motor 420. These will be discussed below.

Figure 2:
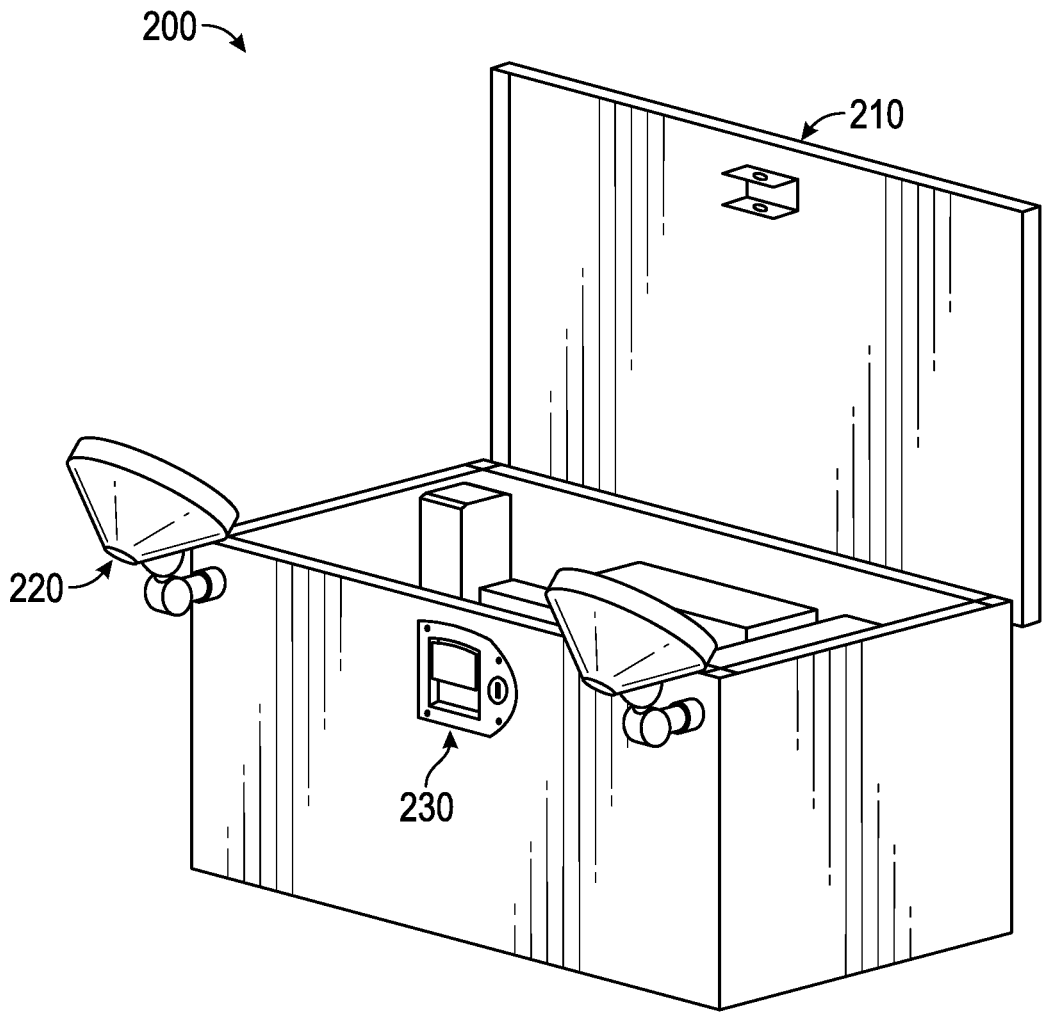
FIG. 2 is an illustration of a base as may be used in one embodiment.

FIG. 2 illustrates one embodiment of the base 200 in accordance with various embodiments described herein. The base 200 is constructed from any material that can provide protection to the enclosure. In the present embodiment, the base 200 is a rectangular box that is hollow in the inside and has a lid 210 capable of protecting the various enclosure inside the base 200. The base 200 incorporates connection points on one of its outside surfaces so that it can be connected to the frame support 300. As shown, a set of lights 220 is attached to the outside of the base 200 so that the signs can be visible in the dark. The base 200 has louvers in one or more sides to aid in cooling and ventilation.

In another embodiment, the base 200 is securely enclosed by a locking latch 230. The enclosure may consist of any combination of a battery providing electric power to the motor 420, a rotation reversal switch, an on/off switch, a battery charger, a fuse holder or a circuit breaker. In one embodiment, the battery is a 12V DC deep cycle marine battery. In some embodiments, the base 200 encloses a battery hold down, that allows the battery to remain securely fixed during transportation of the present embodiment. The battery charger is preferably a 12V DC battery charger, but other types of charges can be utilized. In some embodiments, various electric switches and components such as the on/off power switch, the rotational reversal switch, and the fuse holder are heavy duty components that are water resistant and provide additional protection from natural elements. The fuse holder generally holds an AGC style fuse and protects the battery and the motor 420. In another embodiment, the base 200 further encloses a solar energy controller and panel or a global tracking device. In one embodiment, the base 200 further encloses an electrical pass through that provides a power receptacle on the outside of one of the sides of the base 200 and a standard 110V receptacle inside the base 200. The electrical pass through provides plug in and removal of power cords for charging of the battery. The base can be configured to enclose or store other materials subject to the user's preferences.

Figure 3A:
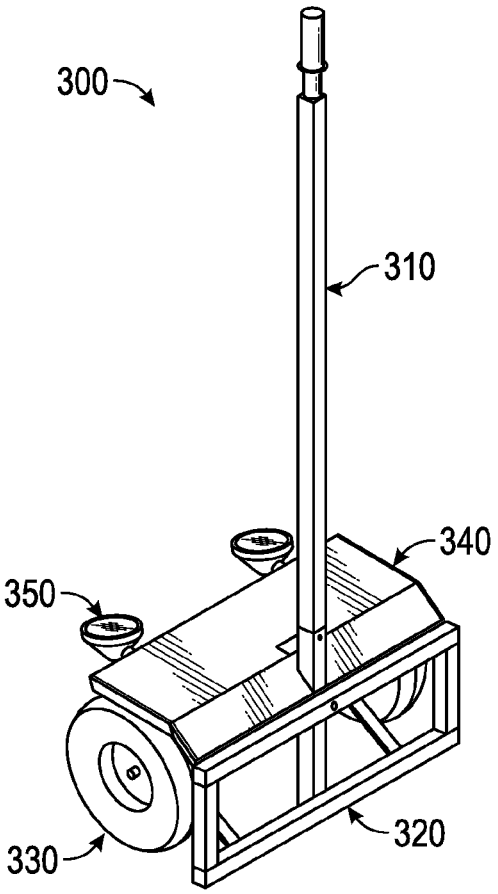
FIG. 3A is an illustration of a frame support as may be used in an embodiment.
Figure 3B:
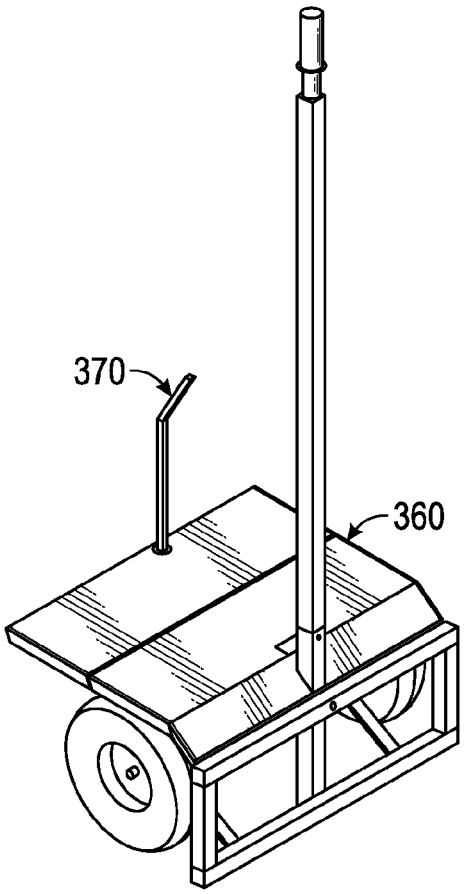
FIG. 3B is an illustration of a frame support configured with an extended platform as may be used in accordance with one embodiment.

FIGS. 3A and 3B illustrate various embodiments of the frame support 300. Referring to FIG. 3A, the frame support is composed of a support pole 310 and a lower frame 320. The first end of the support pole 310 is connected to the lower frame 320 which provides attachment points for the base 200, a set of wheels 330 and a platform 340 that covers the set of wheels 330. The second end of the support pole 310 attaches to the housing 400. The wheels 330 allow the sign waving apparatus 100 to be easily transported. The platform 340 provides a stable platform for various purposes, such as placing a dummy or other materials. In some embodiments, the wheels 330 are composed of a 10-inch pneumatic tire on a steel wheel. As shown, lights 350 are attached to the platform 340 or at other locations on the frame support 300 or on the support pole 310 to illuminate the sign in the dark. The frame support 300 is manufactured from box tubing or other materials that provide sufficient support while still being lightweight. In one embodiment, The support pole 310 is configured such that its length can be adjusted by the user.

Referring to FIG. 3B, the frame support 300 is shown with an extendable platform 360. The extendable platform 360 is configured such that in its collapsed configuration its area is minimized or similar to that of the platform 340. The extendable platform 360 is generally composed of a plurality of elements, that are connected by a hinge or bolts, or rivets to form the extendable platform 360. The extendable platform 360 is further connected to a dummy support 370. The dummy support 370 is generally attached to the rear of the dummy such that the dummy does not fall or tip over backwards, away from the support pole 310. The dummy (not shown) is described in more detail below. The dummy support 370 is made of plastic, aluminum, steel or other materials depending on the weight and size of the dummy. In one embodiment, the extendable platform 360 is configured with attachments points, such that the bottom part of the dummy can be securely fastened to the extendable platform 360.

Figure 4:
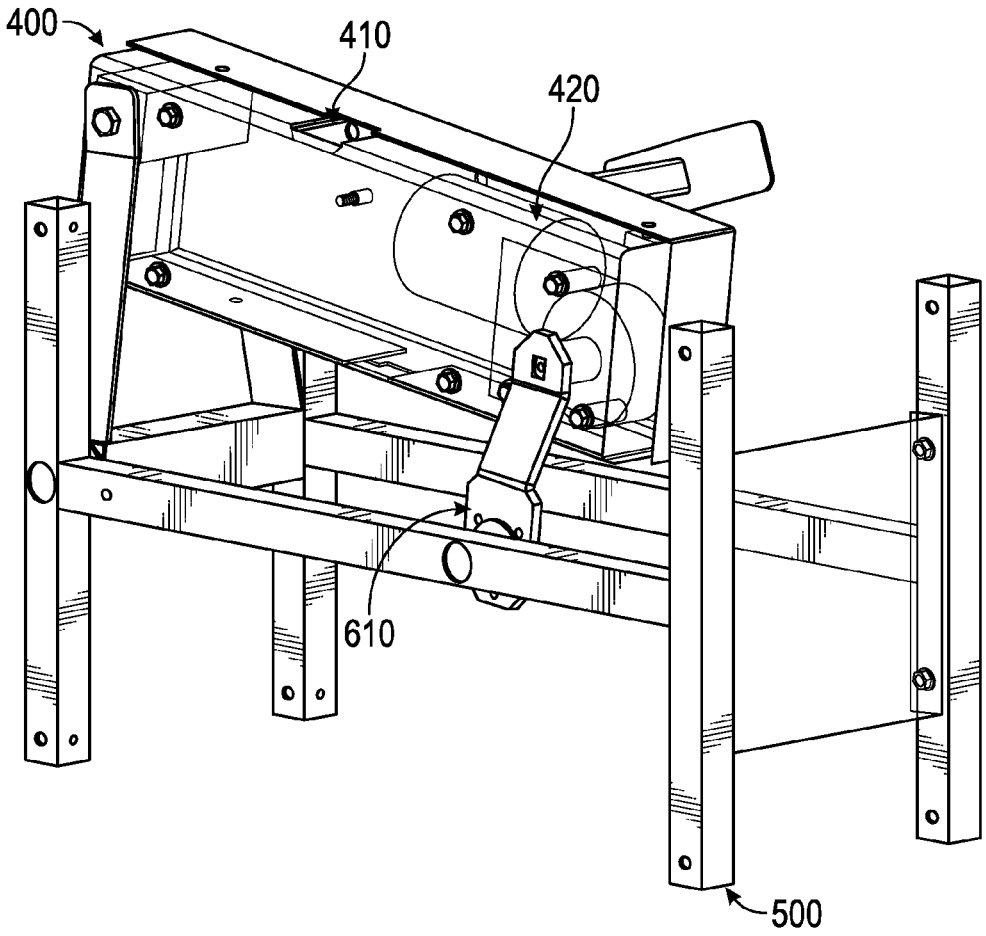
FIG. 4 is an illustration of a sign mount coupled to the housing as may be used in some embodiments.

FIG. 4 illustrates an embodiment of the housing 400 coupled to the sign mount 500. The housing 400 encloses a motor 420 that is further connected to the battery located in the base 200. The housing 400 has an opening 410 that runs through the housing 400 in a vertical direction. This opening allows the top end of the support pole 310 to attach to the housing 400. In one embodiment, a part of the motor 420 is exposed such that it can be directly connected to the drive shaft 610. In another embodiment, the motor 420 is connected to additional gears or a gearbox, which in turn connect to the drive shaft 610. In such cases, the motor 420 will not be visible from the outside. In some embodiments, the motor 420 is a 12V DC gear head motor 420, capable of operating at multiple speeds and in both clockwise and anti-clockwise directions. The operation of the motor 420 is controlled using the components that are enclosed in the base 200. The housing 400 is connected to the support pole 310 in an orientation that is parallel to the ground or at a skewed angle. In one embodiment, the housing 400 connects to the support pole 310 using a fastening device inside the housing 400. The device allows the user to adjust the height of the housing 400 on the support pole 310.

Figure 5:
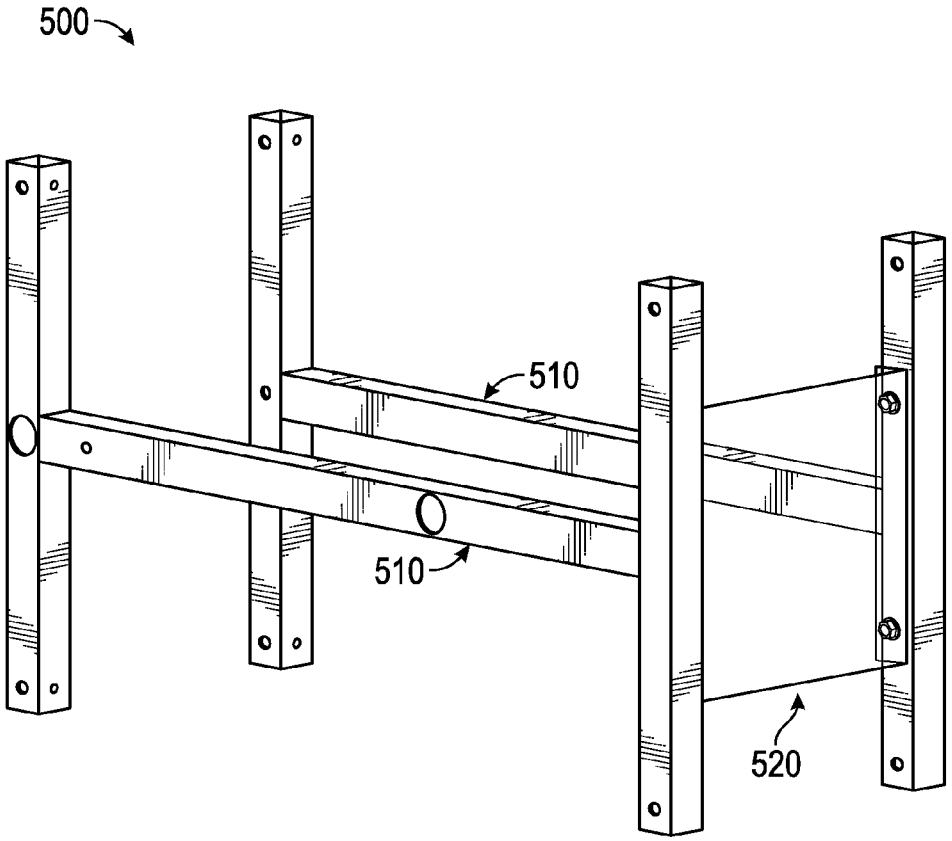
FIG. 5 is an illustration of the sign mount as may be used in an embodiment.

FIG. 5 illustrates an embodiment of the sign mount 500. The sign mount 500 is generally made from box tubing with threaded inserts on the backside for mounting to a swing shaft 600 and/or a drive shaft 610. In some embodiments, the sign mount 500 is composed of two parallel 'H-shaped' tubing 510 that are connected by one or more arm binders 520 at the far ends. In such embodiments, the user can attach signs facing both front and rear directions. Signs are generally attached to the sign mount 500 using fabric hook-and-loop fasteners or other adhesive materials that are attached to multiple surfaces of the sign mount 500 and the signs. In some embodiments, the arm binder 520 is constructed using the same box tubing used in the 'H-shaped' tubing 510 or from solid or clear plastic.

FIGS. 6A-6E illustrate variations of coupling the housing 400 with the sign mount 500. Some of the coupling configurations provide the sign mount 500 with a sideways swinging motion, whereas some configurations provide an up and down rocking motion. Some configurations provide both types of the aforementioned motions.

Figure 6A:
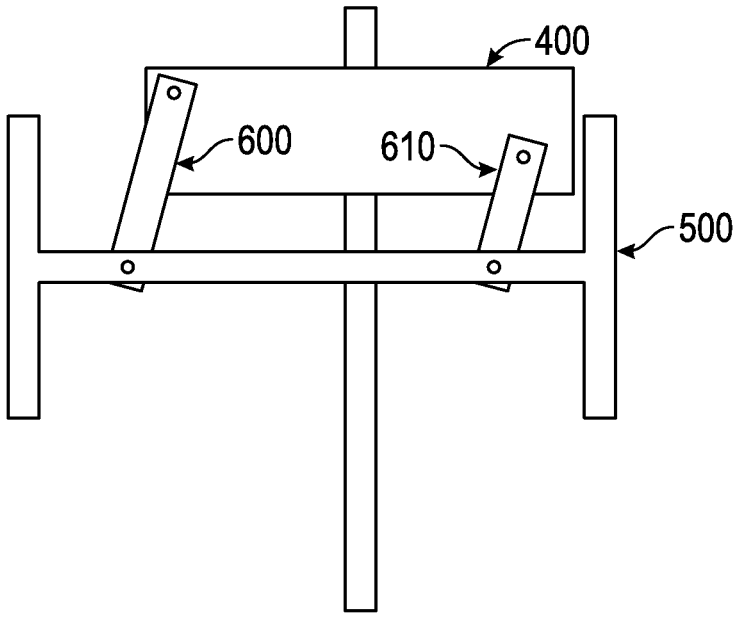
FIG. 6A is an illustration of a sign mount coupled to the housing a swing shaft and a drive shaft as may be used in an embodiment.

Referring to FIG. 6A, the sign mount 500 is connected to the housing 400 to provide both an up and down rocking motion and a sideways swinging motion. The sign mount 500 is coupled to the housing 400 by a swing shaft 600 and a drive shaft 610. The swing shaft 600 is connected to the housing 400 on the first end and to the sign mount 500 on the second end The drive shaft 610 is connected to the motor 420 on the first end and to the sign mount 500 on the second end. The swing shaft 600 rotates freely about both its housing 400 and sign mount 500 connections. The first end of the drive shaft 610 rotates relative to the housing 400. The length of the drive shaft 610 may vary, altering the extent to which the sign mount 500 moves. In some embodiments, the motor 420 can be configured so that the drive shaft 610 fully rotates (360 degrees) providing the sign mount 500 with an up and down rocking motion. In another embodiment, the motor 420 can be configured so that the drive shaft 610 moves in a pendulum-like motion providing the sign mount 500 with a sideways swinging motion. Such motor 420 settings may be adjusted by the user using the rotation reversal switch enclosed in the base 200. In another embodiment, the housing 400 encloses an auto reversing mechanism connected to the motor 420 allowing the user to change the direction of the motor's rotation.

Figure 6B:
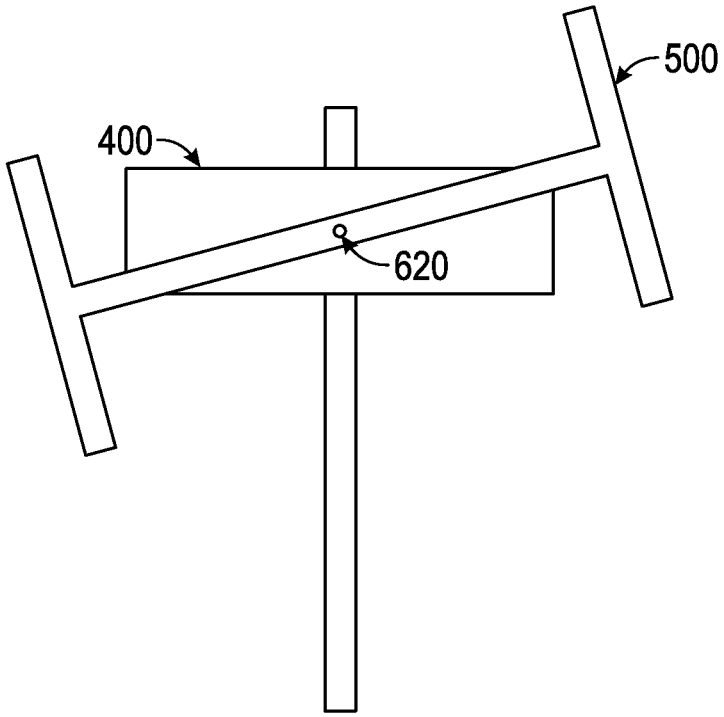
FIG. 6B is an illustration of a sign mount coupled to the housing a pivot point as may be used in an embodiment.

FIG. 6B illustrates an embodiment of the sign mount 500 connected to the housing 400 by a single pivot point 620. The sign mount 500 is coupled to the housing 400 by a pivot point 620 located in the in the center on one of the sides of the housing 400. Preferably, the sign mount 500 attaches to this pivot point 620 through a hole located in the center of the sign mount's 500 'H-shaped' tubing 510. The sign mount 500 is coupled to the housing 400 via a shaft that is connected to the motor 420. A pin can be used to securely hold the sign mount 500 in place. In other embodiments, the hole can be located at any location on the 'H-shaped' tubing 510. In another embodiment, the motor 420 is configured such that the sign mount 500 rotates in complete circular rotations. In one embodiment, the motor 420 is configured such that the sign mount 500 partially rotates back and forth in a rocking see-saw motion. The degree of rotation may be adjusted by the user. In some embodiments, the housing 400 encloses an auto reversing mechanism connected to the motor 420 allowing the user to change the direction of the motor's rotation.

Figure 6C:
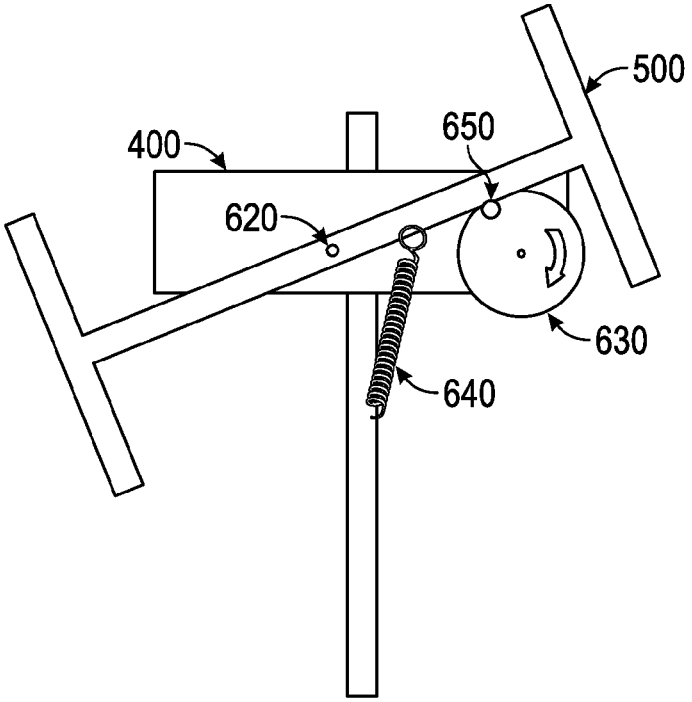
FIG. 6C is an illustration of a sign mount coupled to the housing a circular disc, a pivot point and a spring as may be used in an embodiment.
Figure 6D:
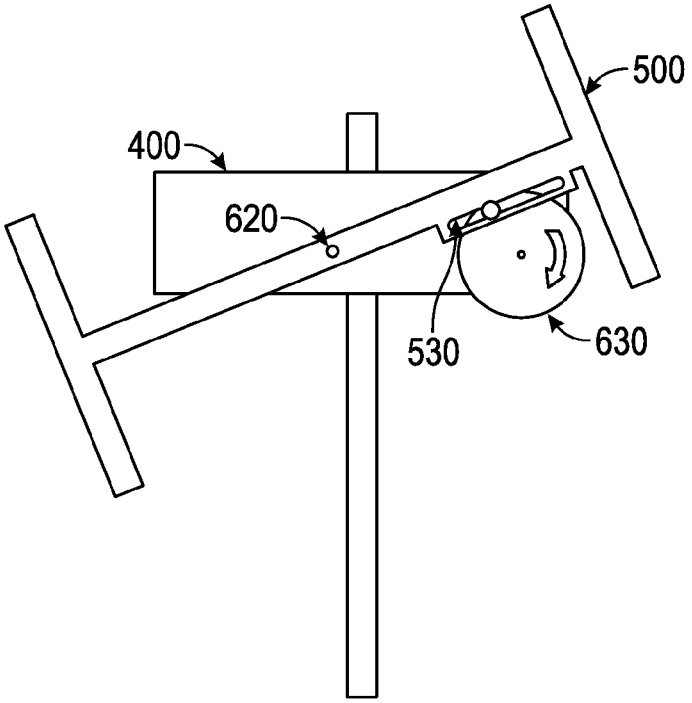
FIG. 6D is an illustration of a sign mount coupled to the housing a circular disc, and a pivot point as may be used in an embodiment.

FIGS. 6C and 6D illustrate embodiments of the sign mount 500 connected to the housing 400 by a circular disc 630 connected to the motor 420.

Referring to FIG. 6C, the sign mount 500 is further connected to a pivot point 620 providing support but is not connected to the motor 420. Instead, a shaft attached to the surface of the housing mates with the pivot point. A pin is used to securely hold the sign mount 500 in place. The sign mount 500 may be further connected to the support pole by a spring 640. In this embodiment, the movement of the sign mount 500 is limited to a see-saw like motion.

Referring to FIG. 6D, the sign mount 500 is connected to the circular disc 630 by an extrusion on the circular disc 630 that tracks an elongated opening 530 on the sign mount 500 resulting in a see-saw like motion. The sign mount 500 is further connected to a pivot point 620 providing support but is not connected to the motor 420. Instead, a shaft attached to the surface of the housing 400 mates with the pivot point 620. A pin is used to securely hold the sign mount 500 in place.

Figure 6E:
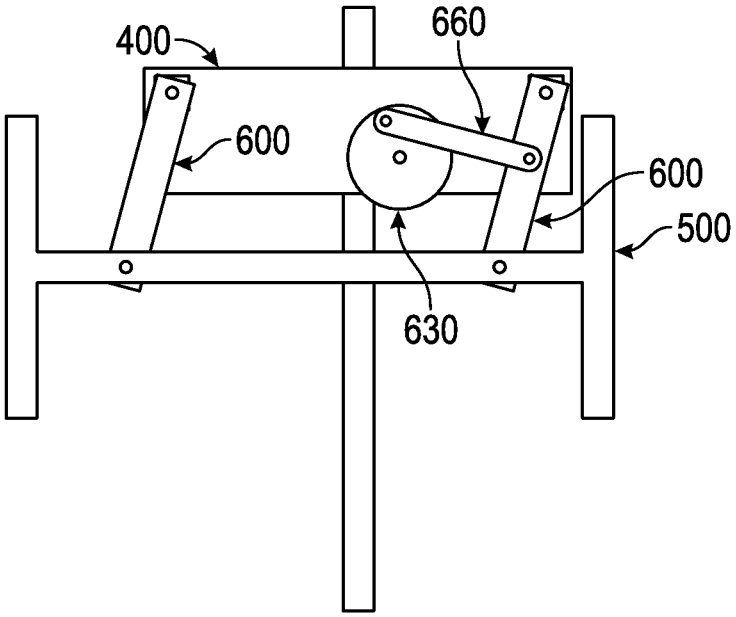
FIG. 6E is an illustration of a sign mount coupled to the housing a plurality of swing shafts and a circular disc connected to the motor in accordance with one embodiment.

FIG. 6E illustrates an embodiment of the sign mount 500 connected to the housing 400 by a plurality of swing shafts 600. One of the swing shafts 600 is further coupled to the motor 420 by a circular disc 630 and a connector shaft 660. In such embodiments the sign mount 500 moves in a sideways swinging motion. In some embodiments, the swing shafts 600 may have different lengths to alter the sign mount's 500 rocking motion.

Figure 7:
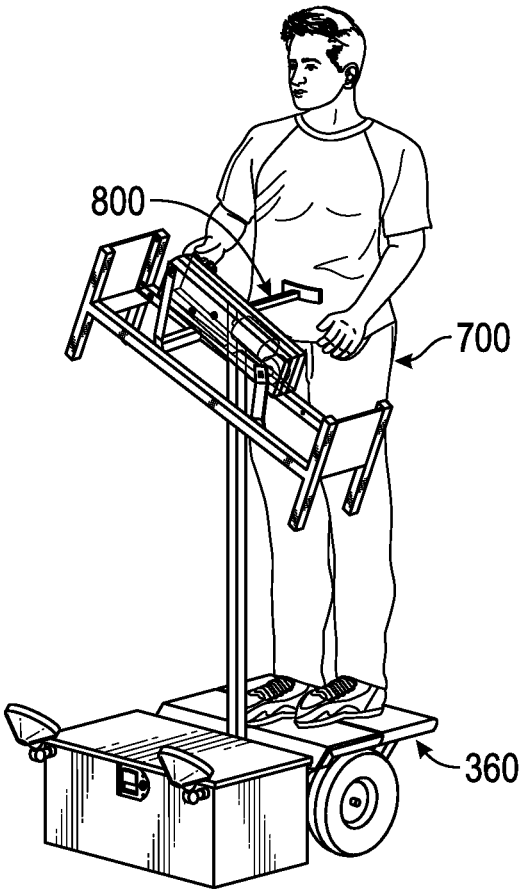
FIG. 7 is an illustration of a dummy attached to the housing and the frame support as may be used in an embodiment.

FIG. 7 illustrates an embodiment of the frame support 300 with a dummy 700 placed on top of the extendable platform 360 to emulate a person moving the sign. The dummy 700 is secured to the present embodiment by a hip bracket 800 connecting the dummy 700 to the housing and the dummy support 370, both of which can be removed by the user when not in use. The dummy 700 may be made of any material and can be covered in wigs or clothing.

Figure 8:
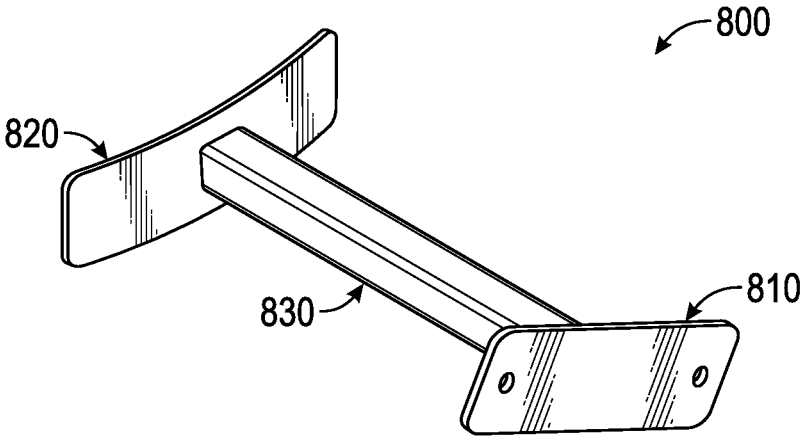
FIG. 8 is an illustration of a hip bracket as may be used in an embodiment.

Referring to FIG. 8, a hip bracket 800 is illustrated. The hip bracket 800 is composed of a housing attachment point 810 on the first end and a dummy attachment point 820 on the second end. The two attachment points are connected by a bar 830 that can be twisted with respect to its axis consistent with the orientation of the housing 400.

Thus, it is seen that a sign waving apparatus is provided. One skilled in the art will appreciate that the invention can be practiced by other than the various embodiments and preferred embodiments, which are presented in this description for purposes of illustration and not of limitation, and the description is limited only by the claims that follow. It is noted that equivalents for the particular embodiments discussed in this description may practice the invention as well.

While various embodiments of the invention have been described above, it should be understood that they have been presented by way of example only, and not of limitation. Likewise, the various diagrams may depict an example configuration for the invention, which is done to aid in understanding the features and functionality that may be included in the invention. The invention is not restricted to the illustrated example configurations, but the desired features may be implemented using a variety of alternative configurations. Indeed, it will be apparent to one of skill in the art how alternative functional, logical or physical configurations may be implemented to implement the desired features of the invention. Also, a multitude of different constituent part names other than those depicted herein may be applied to the various parts. Additionally, with regard to method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, the figures and their accompanying description should not be construed as mandating a particular configuration.

We claim:

1. A sign waving apparatus, comprising:

a base;

a housing enclosing a motor, wherein a draft shaft of the motor is partially exposed outside of the housing;

a frame support coupled to the base, wherein the housing is separated from the base by the frame support; and a sign mount coupled to the housing and the motor, wherein the sign mount moves relative to the housing.

2. The sign waving apparatus of claim 1, wherein the motor can be adjusted to operate at different Revolutions Per Minute and in both rotational directions.

3. The sign waving apparatus of claim 1, wherein the sign mount can be further configured to have a first surface and a second surface to allow signs to be visible from both sides.

4. The sign waving apparatus of claim 1, wherein the base encloses a battery, a rotation reversal switch, an on/off switch, a battery charger, a fuse holder or circuit breaker, a set of lights, solar energy controller and panel, global tracking device, or a locking latch.

5. A sign waving apparatus, comprising:

a base;

a housing enclosing a motor, wherein a draft shaft of the motor is partially exposed outside of the housing;

a frame support coupled to the base wherein the frame support is further composed of a support pole and a lower frame, wherein the first end of the support pole is connected to the lower frame which provides attachment points for the base and the second end of the support pole is connected to the housing: and a sign mount coupled to the housing and the motor, wherein the sign mount moves relative to the housing.

6. A sign waving apparatus, comprising:

a base;

a housing enclosing a motor, wherein a draft shaft of the motor is partially exposed outside of the housing;

a frame support coupled to the base; and a sign mount coupled to the housing and the motor, wherein the sign mount moves relative to the housing, and wherein the sign mount is coupled to the housing by a set of swing shafts, wherein each swing shaft of the set of swing shafts has a first end and a second end and is configured to rotate freely around the first end and second end, and the sign mount is further coupled to the motor by a drive shaft, wherein the drive shaft has a fixed end and a free end and is configured to rotate freely around the free end and rotate relative to the housing at the fixed end.

7. A sign waving apparatus, comprising:

a base;

a housing enclosing a motor, wherein a draft shaft of the motor is partially exposed outside of the housing;

a frame support coupled to the base, wherein the housing is separated from the base by the frame support;

a sign mount coupled to the housing and the motor, wherein the sign mount moves relative to the housing and the sign mount comprises a first surface and a second surface; and wherein a sign attaches to a portion of the first or second surface of the sign mount.

8. The sign waving apparatus of claim 7, wherein the motor can be adjusted to operate at different Revolutions Per Minute and in both rotational directions.

9. The sign waving apparatus of claim 7, wherein the sign mount can be further configured to have a first surface and a second surface to allow signs to be visible from both sides.

10. The sign waving apparatus of claim 7, wherein the base encloses a battery, a rotation reversal switch, an on/off switch, a battery charger, a fuse holder, a set of lights, or a locking latch.

11. A sign waving apparatus, comprising:

a base;

a housing enclosing a motor, wherein a draft shaft of the motor is partially exposed outside of the housing;

a frame support coupled to the base wherein the frame support is further composed of a support pole and a lower frame, wherein the first end of the support pole is connected to the lower frame which provides attachment points for the base and the second end of the support pole is connected to the housing;

a sign mount coupled to the housing and the motor, wherein the sign mount moves relative to the housing and the sign mount comprises a first surface and a second surface; and wherein a sign attaches to a portion of the first or second surface of the sign mount.

12. A sign waving apparatus, comprising:

a base;

a housing enclosing a motor, wherein a draft shaft of the motor is partially exposed outside of the housing;

a frame support coupled to the base;

a sign mount coupled to the housing and the motor, wherein the sign mount moves relative to the housing and the sign mount comprises a first surface and a second surface; and wherein a sign attaches to a portion of the first or second surface of the sign mount, and wherein the sign mount is coupled to the housing by a set of swing shafts, wherein each swing shaft of the set of swing shafts has a first end and a second end and is configured to rotate freely around the first end and second end, and the sign mount is further coupled to the motor by a drive shaft, wherein the drive shaft has a fixed end and a free end and is configured to rotate freely around the free end and rotate relative to the housing at the fixed end.

13. A sign waving apparatus, comprising:

a base;

a housing enclosing a motor;

a frame support coupled to the base and the housing; and a sign mount coupled to the housing and the motor, wherein the sign mount moves relative to the housing; wherein the sign mount is coupled to the housing by a set of swing shafts, wherein each swing shaft of the set of swing shafts has a first end and a second end.

14. The sign waving apparatus of claim 13 wherein each swing shaft is configured to rotate freely around the first end and second end.

15. The sign waving apparatus of claim 14 wherein the sign mount is further coupled to the motor by a drive shaft, wherein the drive shaft has a fixed end and a free end and is configured to rotate freely around the free end and rotate relative to the housing at the fixed end.

16. The sign waving apparatus of claim 13, wherein the motor can be adjusted to operate at different Revolutions Per Minute and in both rotational directions.

17. The sign waving apparatus of claim 13, wherein the frame support is further composed of a support pole and a lower frame, wherein the first end of the support pole is connected to the lower frame which provides attachment points for the base and the second end of the support pole is connected to the housing.

18. The sign waving apparatus of claim 13, wherein a draft shaft of the motor is partially exposed outside of the housing.

19. The sign waving apparatus of claim 13, wherein the first swing shaft is a first length and the second swing shaft is a second length that is different from the first length.

20. The sign waving apparatus of claim 19, wherein a draft shaft of the motor is partially exposed outside of the housing.

* * * * *